US008175472B2

(12) United States Patent
Suzuki

(10) Patent No.: US 8,175,472 B2
(45) Date of Patent: May 8, 2012

(54) IMAGE FORMING APPARATUS

(75) Inventor: Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 448 days.

(21) Appl. No.: 12/411,795

(22) Filed: Mar. 26, 2009

(65) Prior Publication Data

US 2009/0245825 A1 Oct. 1, 2009

(30) Foreign Application Priority Data

Mar. 27, 2008 (JP) ..... 2008-082967

(51) Int. Cl.
*G03G 15/00* (2006.01)

(52) U.S. Cl. ..... 399/44

(58) Field of Classification Search ..... 399/44, 399/69, 94, 33
See application file for complete search history.

(56) References Cited

U.S. PATENT DOCUMENTS

| | | | | |
|---|---|---|---|---|
| 5,281,793 | A * | 1/1994 | Gavin et al. | 399/69 |
| 2005/0201767 | A1 * | 9/2005 | Peng et al. | 399/69 |
| 2011/0052235 | A1 * | 3/2011 | Barton et al. | 399/69 |

FOREIGN PATENT DOCUMENTS

| | | | |
|---|---|---|---|
| JP | 63-76290 | A | 4/1988 |
| JP | 7-225530 | A | 8/1995 |
| JP | 2003-076177 | A | 6/2003 |
| JP | 2005-173100 | | 6/2005 |

OTHER PUBLICATIONS

JP Office Action dtd Feb. 9, 2010, JP Appln. 2008-082967, partial English translation.

* cited by examiner

*Primary Examiner* — Susan Lee
(74) *Attorney, Agent, or Firm* — Banner & Witcoff, Ltd.

(57) ABSTRACT

An image forming apparatus includes: a detected member of which a temperature is to be detected; a temperature sensor including a contact portion provided to contact the detected member, the temperature sensor being configured to detect the temperature of the detected member; and a condition determining unit. The condition determining unit is configured to control electric power supplied to the temperature sensor such that the temperature sensor self-heats during a heating time period, and determine a condition of the contact portion based on the temperature detected by the temperature sensor after the temperature sensor starts self-heating.

20 Claims, 7 Drawing Sheets

IMAGE FORMING APPARATUS

CROSS-REFERENCE TO RELATED APPLICATIONS

This application is based upon and claims priority from Japanese Patent Application No. 2008-082967 filed on Mar. 27, 2008, the entire contents of which are incorporated herein by reference.

TECHNICAL FIELD

The present invention relates to an image forming apparatus such as a printer.

BACKGROUND

An image forming apparatus of an electrophotographic system generally includes a fixing device that fixes a toner image, which is transferred to a sheet of paper, to the sheet of paper. The fixing device includes a heat roller and a press roller disposed so as to press the heat roller. The sheet of paper on which the toner image is transferred is conveyed between the heat roller and the press roller. Then, the toner image is fixed to the sheet of paper by heating and pressurizing the sheet of paper while the sheet of paper passes between the heat roller and the press roller. Accordingly, the image is formed on the recording sheet.

An example of such fixing device includes two thermistors, a first thermistor and a second thermistor, for detecting a surface temperature of the heat roller. The first thermistor is disposed so as to contact a center area of a surface of the heat roller in a width direction thereof. Then, a heater mounted in the heat roller is controlled so as to make a temperature detected by the first thermistor be a target temperature set in advance. The second thermistor is disposed so as to contact an end area of the surface of the heat roller in the width directions i.e., an area out of the contact area with a sheet of paper on the surface of the heat roller. For example, when image formations on sheets of papers with a relatively narrow width are repeatedly carried out successively, the surface temperature of the center area of the heat roller in the width direction is the target temperature, and in contrast thereto, heat at the end area of the heat roller in the width direction is not drawn by the recording sheets, which may lead to an anomalous heating condition due to the heat accumulation. The second thermistor is provided in order to detect its anomalous heating condition to interrupt heating of the heat roller by the heater (interrupt the image formations).

Further, extraneous matter (foreign matter) such as paper dust or toner adhered to the surface of the heat roller is transferred to the first thermistor, and the transferred extraneous matter is accumulated on the first thermistor, which may reduce a sensitivity of the first thermistor in some cases. If the sensitivity of the first thermistor is reduced, a temperature detected by the first thermistor becomes lower than an actual surface temperature of the heat roller. In this case, the heater continues to heat the heat roller even after an actual surface temperature of the heat roller has reached the target temperature. As a result, the heat roller may be in an anomalous heating condition.

In order to suppress these disadvantages, for example, JP-A-2005-173100 describes a following method including: starting warming-up of the heat roller by the heater in response to a power-on of the image forming apparatus: obtaining a difference between a temperature detected by the first thermistor and a temperature detected by the second thermistor during the warming-up; and compensating the temperature detected by the first thermistor based on the temperature difference (which shows an adhesion condition of extraneous matter on the first thermistor).

SUMMARY

However, because a heating value applied to the first thermistor greatly varies in accordance with the type of the heat roller and the like, a temperature detected by the first thermistor during warming-up depends on, not only an adhesion condition of extraneous matter on the first thermistor, but also the type of the heat roller. Therefore, in order to precisely compensate the temperature detected by the first thermistor in accordance with a difference between a temperature detected by the first thermistor and a temperature detected by the second thermistor, it is necessary to determine a compensation level corresponding to the temperature difference in consideration of a type of the heat roller. Therefore, it is necessary to greatly modify a table or a computation expression (parameters) to determine a compensation level corresponding to a temperature difference for each type of heat roller.

The present invention was made in consideration of the above described circumstances, and an object thereof is to provide an image forming apparatus capable of determining a condition of a contact or facing portion of a temperature sensor which contacts or faces a detected member of which a temperature to be detected without consideration of the type of a member to be detected.

According to an aspect of the invention, there is provided an image forming apparatus comprising: a detected member of which a temperature is to be detected; a temperature sensor comprising a contact portion provided to contact the detected member, the temperature sensor being configured to detect the temperature of the detected member; and a condition determining unit configured to control electric power supplied to the temperature sensor such that the temperature sensor self-heats during a heating time period, and determine a condition of the contact portion based on the temperature detected by the temperature sensor after the temperature sensor starts self-heating.

According to another aspect of the invention, there is provided a computer readable medium having a computer program stored thereon and readable by a computer, said computer program, when executed by the computer, causes the computer to perform operations for an image forming apparatus that comprises a detected member of which a temperature is to be detected; and a temperature sensor comprising a contact portion provided to contact the detected member, the temperature sensor being configured to detect the temperature of the detected member, said operations comprising: controlling electric power supplied to the temperature sensor such that the temperature sensor self-heats during a heating time period; and determine a condition of the contact portion based on the temperature detected by the temperature sensor after the temperature sensor starts self-heating.

According to yet another aspect of the invention, there is provided an image forming apparatus comprising: a detected member of which a temperature is to be detected; a temperature sensor comprising a facing portion provided to face the detected member, the temperature sensor being configured to detect the temperature of the detected member; and a condition determining unit configured to control electric power supplied to the temperature sensor such that the temperature sensor self-heats during a heating time period, and determine a condition of the facing portion based on the temperature detected by the temperature sensor after the temperature sensor starts self-heating.

DESCRIPTION

1. General Configuration of Printer

Figure 1:
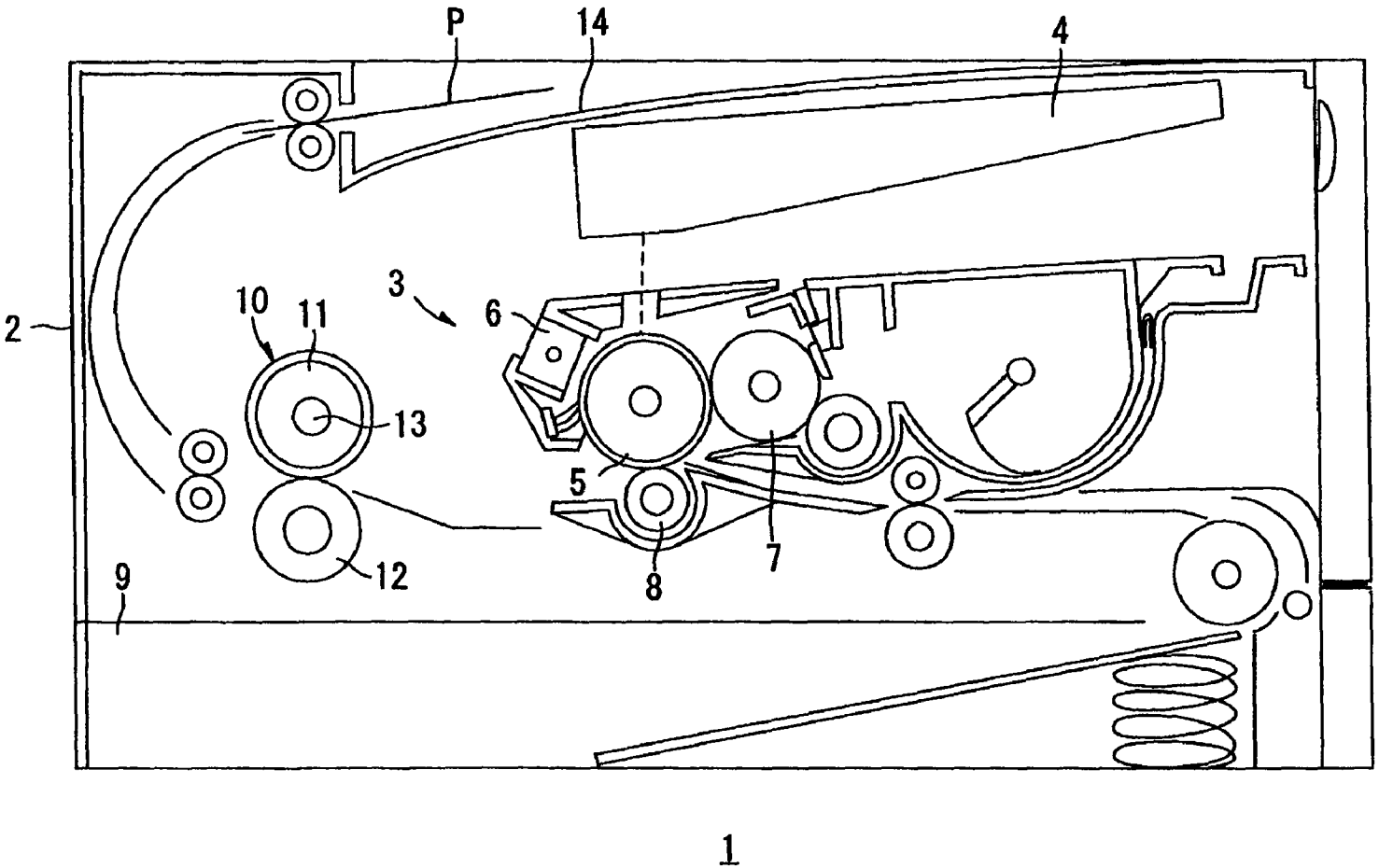
FIG. 1 is a side sectional view of a printer as an example of an image forming apparatus according to one embodiment of the present invention.

FIG. 1 is a side sectional view of a printer 1 as an example of an image forming apparatus according to one embodiment of the present invention.

The printer 1 includes a process unit 3 is disposed at a center area of an inside of a main body casing 2 of the printer 1. An exposure device 4 including a laser system is disposed above the process unit 3.

The process unit 3 includes a photoconductive drum 5, a scorotron charger 6, a developing roller 7, and a transfer roller 8. The surface of the photoconductive drum 5 is electrically charged uniformly by the scorotron charger 6 as the photoconductive drum 5 rotates, and thereafter, the surface is selectively exposed by a laser beam output from the exposure device 4. This exposure selectively eliminates the electric charge from the surface of the photoconductive drum 5, so as to form an electrostatic latent image on the surface of the photoconductive drum 5. Developing bias is applied to the developing roller 7. When the electrostatic latent image faces the developing roller 7, toner carried on the developing roller 7 is supplied to the electrostatic latent image by a potential difference between the electrostatic latent image and the developing roller 7. Consequently, a toner image is formed on the surface of the photoconductive drum 5.

The printer 1 further includes a sheet feed cassette 9 that is capable of storing a plurality of sheets of paper P as an example of recording sheets therein and is disposed at the bottom of the main body casing 2. The sheets of paper P stored in the sheet feed cassette 9 are supplied one piece at a time to a space between the photoconductive drum 5 and the transfer roller 8. Then, the toner image on the surface of the photoconductive drum S is transferred to the sheet of paper P due to transfer bias applied to the transfer roller 8 when the toner image faces a piece of the sheets of paper P.

The printer 1 further includes a fixing unit 10 provided at the downstream side in a conveying direction of the sheet of paper P with respect to the process unit 3. The sheet of paper P on which the toner image is transferred is conveyed to the fixing unit 10. The fixing unit 10 includes: a heating roller 11 serving as an example of a detected member of which a temperature is to be detected; and a pressure roller 12 pressed against and contacting the heating roller 11. The heating roller 11 includes: a metal pipe whose surface is coated with fluorine resin; and a heater 13 as an example of a heating member for heating inserted in the metal pipe. The pressure roller 12 includes a metal roller shaft and a rubber material covering the roller shaft. While the sheet of paper P passes through the space between the heating roller 11 and the pressure roller 12, the toner image on the sheet of paper P is heated by the heating roller 11 and is pressurized between the heating roller 11 and the pressure roller 12. Accordingly, the toner image is fixed to the sheet of paper P.

The sheet of paper P on which the toner image is fixed is discharged to a paper discharging tray 14 provided at an upper surface of the main body casing 2.

2. Control System of Printer

Figure 2:
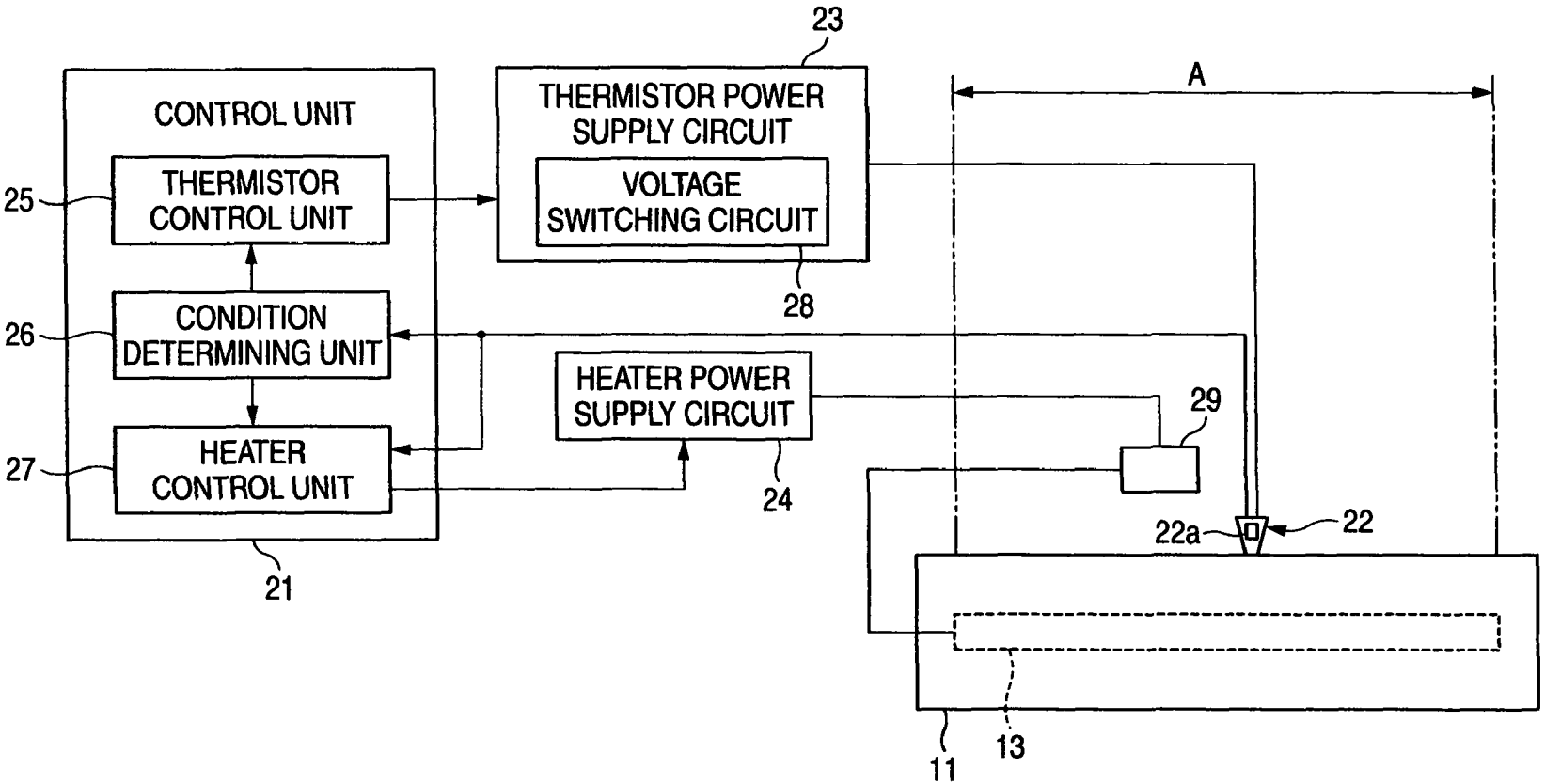
FIG. 2 is a block diagram showing a configuration of a control system of the printer.

FIG. 2 is a block diagram showing a configuration of a control system of the printer 1.

The printer 1 includes a control unit 21. The control unit includes a microcomputer including a CPU, a RAM, a ROM, and the like. The printer 1 further includes: a center thermistor 22 as an example of a temperature sensor used for detecting a surface temperature of the heating roller 11; a thermistor power supply circuit 23 configured to supply electric power to the center thermistor 22, and a heater power supply circuit 24 configured to supply electric power to the heater 13. The center thermistor 22 is disposed so as to contact a contact area A of the surface of the heating roller 11 to be contacted with the sheet of paper P. In more detail, the center thermistor 22 is disposed so as to contact the center area of the surface of the heating roller 11 in the width direction of the heating roller 11 (in the axial direction of the heating roller 11). The center thermistor 22 includes a resistive element 22*a* for temperature detection. The resistive element 22*a* is configured to vary a value of resistance in accordance with temperature changes of the resistive element 22*a* itself. Then, a temperature is detected by utilizing changes in the value of resistance of the resistive element 22*a*.

The control unit 21 includes a thermistor control unit 25, a condition determining unit 26, and a heater control unit 27, as functional processing units implemented by software achieved by the CPU executing a program stored in the ROM.

The thermistor control unit 25 controls the thermistor power supply circuit 23 to control electric power supplied to the center thermistor 22 from the thermistor power supply circuit 23. In detail, the thermistor power supply circuit 23 includes a voltage switching circuit 28 configured to switch an output voltage. The selectable output voltages of the voltage switching circuit 28 include a first voltage and a second voltage. The thermistor control unit 25 switches ON/OFF of a switching element (not shown) included in the voltage switching circuit 28, to switch a voltage applied to the center thermistor 22 to the first voltage and the second voltage. The first voltage is a voltage suitable for a temperature detection of the center thermistor 22. When the first voltage is applied to the center thermistor 22, a self-heating value of the resistive element 22*a* of the center thermistor 22 is negligibly small. The second voltage is much higher than the first voltage, which can cause the resistive element 22*a* of the center thermistor 22 to have self-heating actively. When the second voltage is applied to the center thermistor 22, the center thermistor 22 has self-heating to the extent of increasing its heating value to be non-negligible.

The condition determining unit 26 executes condition determining processing which will be described later, to determine a condition of a contact portion of the center thermistor 22 which contacts with the heating roller 11 (herein-after simply referred to as "contact portion of the center thermistor 22") based on an output signal from the center thermistor 22.

The heater control unit 27 controls the heater power supply circuit 24 based on a condition of the contact portion of the center thermistor 22 and an output signal from the center thermistor 22, to control electric power supplied to the heater 13 from the heater power supply circuit 24. In detail, the heater control unit 27 sets (corrects) a target temperature for a surface temperature of the heating roller 11 based on a condition of the contact portion of the center thermistor 22, and performs feedback control for the heater power supply circuit 24 so as to make a temperature detected by the center thermistor 22 conform to the target temperature.

Note that, in order to prevent anomalous heating of the heating roller 11 due to a failure in the center thermistor 22 or the like, a bimetal switch 29 is provided on a power supply path from the heater power supply circuit 24 to the heater 13. The bimetal switch 29 shuts off a power supply when a surface temperature of the heating roller 11 exceeds a given temperature.

3. Condition Determining Processing

Figure 3:
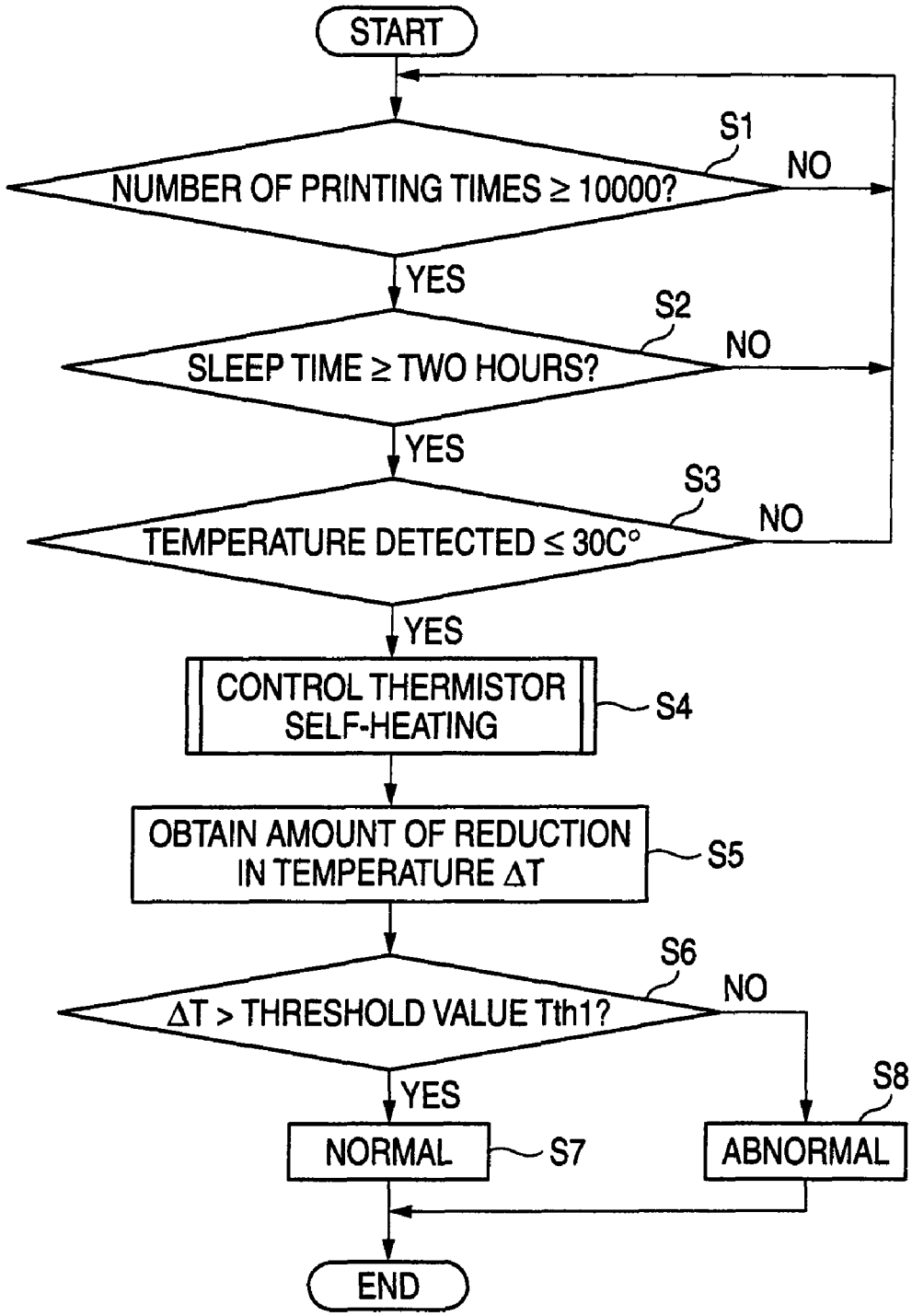
FIG. 3 is a flowchart of condition determining processing
Figure 4:
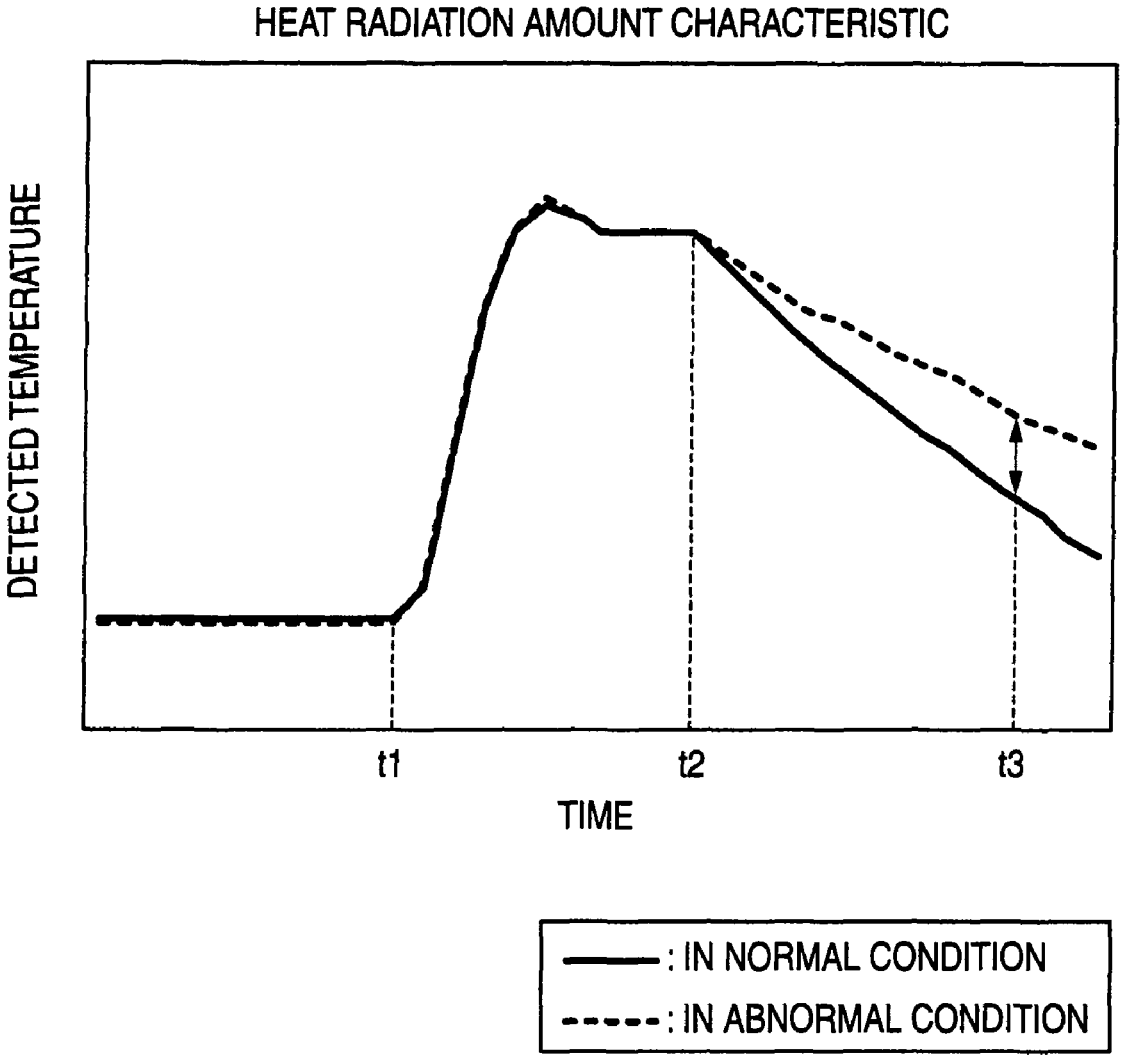
FIG. 4 is a graph showing changes in a temperature detected by a center thermistor in a process of condition determining processing.

FIG. 3 is a flowchart of condition determining processing. FIG. 4 is a graph showing changes in a temperature detected by the center thermistor in process of condition determining processing.

The condition determining processing is executed during a period when an image forming operation (an operation of forming an image on the sheet of paper P) is not carried out. In the condition determining processing, first, it is determined whether a number of printing times (a number of times of image forming operations) reaches 10000 or more without new determination after previous determination of a condition of the contact portion of the center thermistor 22 (S1). If the number of printing times is less than 10000 (S1: NO), the processing returns to S1.

If the number of printing times is 10000 or more (S1: YES), it is determined whether a sleep time which is a duration time in a sleep mode reaches two hours or more at that time point (S2). When an image forming operation is completed and thereafter no new image forming operation is carried out for a given time period (for example, 5 minutes but not limited thereto), the printer 1 shifts to a sleep mode and interrupts heating of the heater 13. If the sleep time is shorter than two hours (S2: NO), the process returns to S1.

If the sleep time is two hours or more (S2: YES), it is determined whether a temperature detected by the center thermistor 22 is to 30° C. or less (S3). If the temperature detected by the center thermistor 22 is higher than 30° C. (S3: NO), the processing returns to S1.

If the temperature detected by the center thermistor 22 is 30° C. or less, thermistor self-heating control is executed (S4). In this thermistor self-heating control, a voltage applied to the center thermistor 22 is switched from the first voltage to the second voltage. Thereby, the center thermistor 22 has self-heating, which rapidly raises the temperature of the center thermistor 22. As shown in FIG. 4, when a heating time period t1-t2 elapses after the voltage applied to the center thermistor 22 is switched from the first voltage to the second voltage, the voltage applied to the center thermistor 22 is returned from the second voltage to the first voltage. The heating time period t1-t2 may be predetermined. Thereby, the center thermistor 22 does not actively have self-heating. Therefore, thereafter, the temperature of (temperature detected by) the center thermistor 22 decrease due to a heat radiation from the center thermistor 22. The heating time period t1-t2 is, for example, 30 seconds but not limited thereto.

For example, if a large amount of extraneous matter (foreign matter) such as paper dust or toner is adhered to the contact portion of the center thermistor 22, the heat radiation is interrupted by the extraneous matter. Therefore, a decrease of temperature of the center thermistor 22 is delayed as compared with a case in which not large amount of extraneous matter is adhered to the contact portion. Further, if a condition of mounting the center thermistor 22 is changed such that the contact portion of the center thermistor 22 is separated from (does not contact) the surface of the heating roller 11, a heat transfer from the center thermistor 22 to the heating roller 11 is interrupted. Therefore, a decrease of temperature of the center thermistor 22 is delayed as compared with a case in which the contact portion of the center thermistor 22 contacts the surface of the heating roller 11.

Therefore, at a time point when a heat-radiating time period t2-t3 elapses after the voltage applied to the center thermistor 22 is returned from the second voltage to the first voltage, an amount of reduction in temperature ΔT of the center thermistor 22 during the heat-radiating time period is obtained (S5). The heat-radiating time period may be predetermined, for example, two minutes.

Then, it is determined whether a condition of the contact portion of the center thermistor 22 is normal or abnormal, depending on whether the amount of reduction in temperature ΔT is greater than a threshold value Tth1 (for example, Tth1=20° C.) as an example of a comparative value. The threshold value Tth1 may be experimentally set in advance, and stored in the ROM of the control unit 21. In detail, an amount of reduction in temperature of the center thermistor 22 during the heat-radiating time period t2-t3 is obtained by experiment in a condition in which the contact portion of the center thermistor 22 is normal (a condition in which the contact portion of the center thermistor 22 has no (or low) adhesion of extraneous matter and contacts the heating roller 11). Then, the threshold value Tth1 is set based on the obtained amount of reduction in temperature.

If the amount of reduction in temperature ΔT is greater than the threshold value Tth1 (S6: YES), it is determined that a condition of the contact portion of the center thermistor 22 is normal (S7), and the condition determining processing ends. On the other hand, if the amount of reduction in temperature ΔT is the threshold value Tth1 or less (S6: NO), it is determined that a condition of the contact portion of the center thermistor 22 is abnormal (S8), as a large amount of extraneous matter (for example, such an amount of destroying the sufficient sensitivity of the center thermistor 22) is adhered to the contact portion of the center thermistor 22, or as the contact portion of the center thermistor 22 is spaced from (does not contact) the surface of the heating roller. Then, the condition determining processing ends. Then, if it is determined that a condition of the contact portion of the center thermistor 22 is abnormal, the control unit 21 outputs a control signal to indicate warning on a human-sensible indicator such as a display (not shown) of the printer 1.

4. Advantages

As described above, the center thermistor 22 configured to detect a temperature of the heating roller 11 is provided so as to contact the heating roller 11. In order to determine a condition of the contact portion of the center thermistor 22 which contacts the heating roller 11, electric power supplied to the center thermistor 22 is controlled so as to cause the center thermistor 22 to have self-heating. Then, a condition of the contact portion of the center thermistor 22 is determined based on a temperature detected by the center thermistor 22 after starting the self-heating.

The center thermistor 22 is provided so as to contact the contact area contacting the sheet of paper P on the heating roller 11. Then, a condition of the contact portion of the center thermistor 22 is determined based on an amount of reduction in temperature detected by the center thermistor 22 during a heat-radiating time period (which may be set in advance) after completion of the self-heating of the center thermistor 22.

Because the center thermistor 22 is configured to have self-heating, a substantially constant heating amount is supplied to the center thermistor 22 independently of the type of the heating roller 11. Accordingly, it is possible to determine a condition of the contact portion of the center thermistor 22 without depending on the type of the heating roller 11. In detail, it is possible to determine an adhesion condition of extraneous matter on the contact portion of the center thermistor 22 without depending on the type of the heating roller 11. Further, it is possible to determine whether the contact portion of the center thermistor 22 contacts the surface of the heating roller 11 without depending on the type of the heating roller 11.

The heating roller 11 contacts a piece of the sheets of paper P on which an image is recorded. Therefore, extraneous matter adhered to the sheet of paper P is transferred to the heating roller 11. The extraneous matter transferred to the heating roller 11 is further transferred to the center thermistor 22 from the heating roller 11. If the extraneous matter is adhered to the center thermistor 22, the sensitivity of the center thermistor 22 is deteriorated. In this embodiment, an adhesion condition (for example, whether a certain amount of extraneous matter which deteriorate a sufficient sensitivity of the center thermistor 22 is adhered to the center thermistor 22) is determined. Therefore, it is possible to precisely detect a temperature of the heating roller 11 by the determination, and correcting a temperature detected by the center thermistor 22 based on the adhesion condition.

Further, a series of processing steps (the steps on and after S4 shown in FIG. 3) for determining a condition of the contact portion of the center thermistor 22 is executed under the condition that an image forming operation is carried out 10000 times or more without determining a condition of the contact portion. Thereby, it is possible to suppress a frequent execution of the steps on and after S4 shown in FIG. 3. Note that the standard that is 10000 times or more is just an example, and may be set to a given number of times to an extent that frequently executing the steps on and after S4 shown in FIG. 3 do not cause adverse effects.

Moreover, the steps on and after S4 shown in FIG. 3 are executed under the condition that a temperature detected by the center thermistor 22 is 30° C. or less. If a temperature detected by the center thermistor 22 is higher than 30° C. at a time point when the thermistor self-heating control is started, the temperature at that time may influences temperature changes after starting the self-heating control of the center thermistor 22, which may deteriorate an accuracy of the determination of a condition of the contact portion of the center thermistor 22. Therefore, by executing the steps on and after S4 shown in FIG. 3 under the condition that the temperature detected by the center thermistor 22 is 30° C. or less, it is possible to satisfactorily determine a condition of the contact portion of the center thermistor 22. Note that the standard that is 30° C. is just an example, and may be appropriately set based on a room temperature.

The heater 13 heating the heating roller 11 is provided in the printer 1. Then, the steps on and after S4 shown in FIG. 3 are executed under the condition that a non-heating condition of the heating roller 11 by the heater 13 continues for two hours or more. If heating of the heating roller 11 by the heater 13 is carried out immediately before starting thermistor self-heating control, the heating (thermal storage in the heating roller 11 or the pressure roller 12) may influence temperature changes after starting the self-heating control of the center thermistor 22, which may deteriorate an accuracy of the determination of a condition of the contact portion of the center thermistor 22. Therefore, by executing the series of processing steps under the condition that a non-heating condition of the heating roller 11 by the heater 13 continues for two hours or more, it is possible to satisfactorily determine a condition of the contact portion of the center thermistor 22. Note that the standard that is two hours is just an example, and may be set to a time which is sufficient to lower the heating roller 11, the pressure roller 12, and the center thermistor 22 which have been heated to a room temperature.

Note that, in a condition in which a condition of the contact portion of the center thermistor 22 is normal, at a timing when a predetermined time elapses after starting the self-heating of the center thermistor 22 (for example, a clock time t3 shown in FIG. 4), the temperature of the center thermistor 22 comes to be substantially a predetermined temperature. In this embodiment, a value corresponding to the predetermined temperature is stored as a comparative value in advance in the ROM of the control unit 21, and a temperature detected by the center thermistor 22 at a timing when the predetermined time elapses after starting the self-heating of the center thermistor 22 is obtained. In a case in which the detected temperature and the comparative value are greatly different from each other (for example, in a case in which a deviation therebetween is higher than 10° C.), it is possible to determine that a condition of the contact portion of the center thermistor 22 is abnormal.

5. Configuration of Control System

Figure 5:
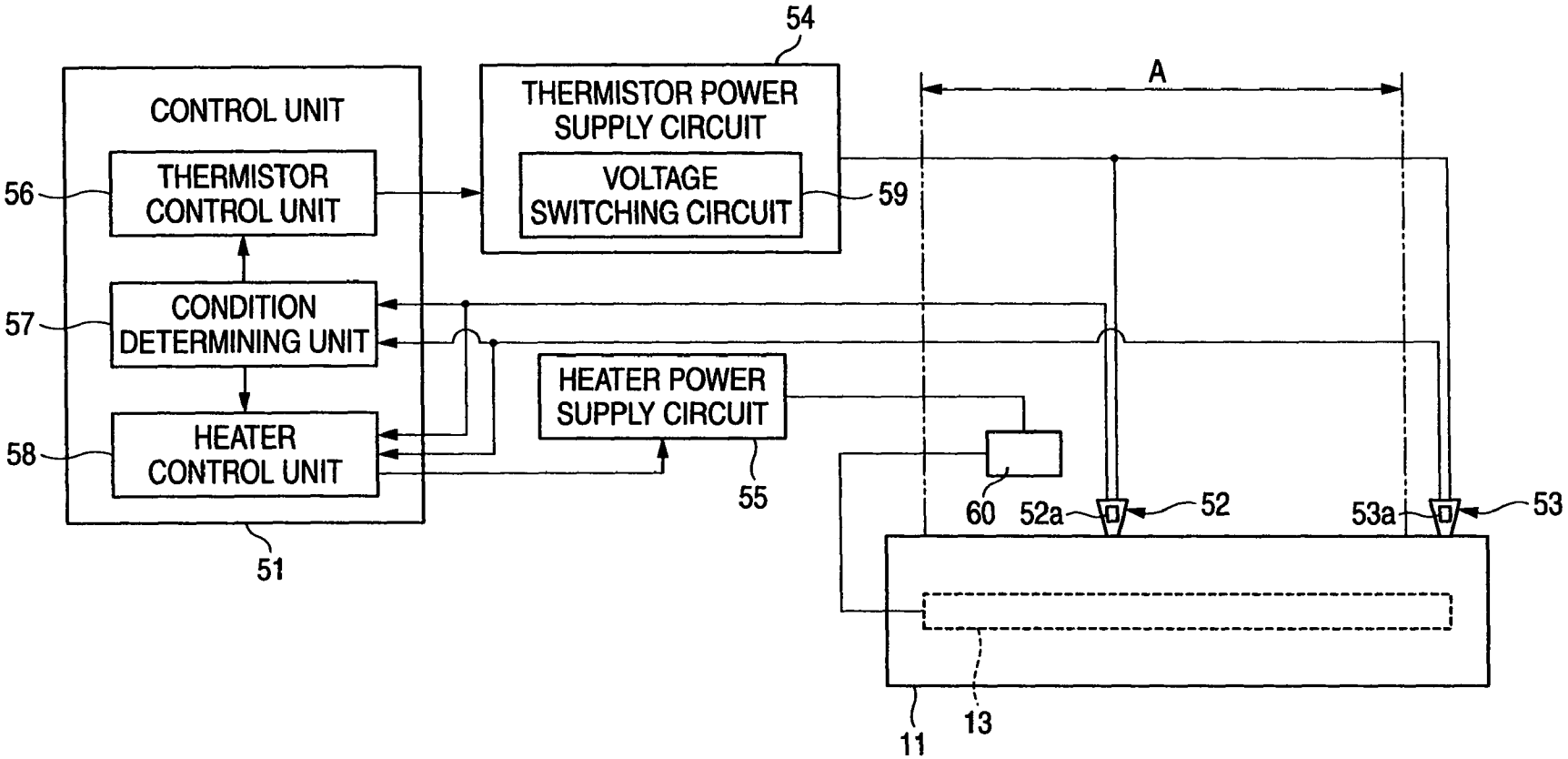
FIG. 5 is a block diagram showing another configuration of a control system of the printer.

FIG. 5 is a block diagram showing another configuration of a control system of the printer.

The printer 1 includes a control unit 51. The control unit 51 includes a microcomputer including a CPU, a RAM, a ROM, and the like. The printer 1 further includes a center thermistor 52 as an example of a first temperature sensor configured to detect a surface temperature of the heating roller 11, a side thermistor 53 as an example of a second temperature sensor configured to detect a surface temperature of the heating roller 11, a thermistor power supply circuit 54 configured to supply electric power to the center thermistor 52 and the side thermistor 53, and a heater power supply circuit 55 configured to supply electric power to the heater 13.

The center thermistor 52 is disposed so as to contact a contact area A with the sheet of paper P on the surface of the heating roller 11. In more detail, the center thermistor 52 is disposed so as to contact the center area of the surface of the heating roller 11 in the width direction (the axial direction). The center thermistor 52 has a resistive element 52*a* for temperature detection.

The side thermistor 53 is disposed so as to contact an area other than the contact area A on the surface of the heating roller 11. As the side thermistor 53, a thermistor of the same type (having the same characteristic) as the center thermistor 52 is adopted. The side thermistor 53 has a resistive element 53*a* for temperature detection.

The control unit 51 includes a thermistor control unit 56, a condition determining unit 57, and a heater control unit 58 as functional processing units implemented by Software achieved by the CPU executing a program stored in the ROM.

The thermistor control unit 56 controls the thermistor power supply circuit 54 to control electric power supplied to the center thermistor 52 and the side thermistor 53 from the thermistor power supply circuit 54. In detail, the thermistor power supply circuit 54 includes a voltage switching circuit 59 configured to switch an output voltage. The selectable output voltages of the voltage switching circuit 28 include a first voltage and a second voltage. The thermistor control unit 56 switches ON/OFF of a switching element (not shown) included in the voltage switching circuit 59, to switch an output voltage to the first voltage and the second voltage. An output voltage from the thermistor power supply circuit 54 is applied to the center thermistor 52 and the side thermistor 53 in parallel.

The condition determining unit 57 executes second condition determining processing which will be described later, to determine a condition of the contact portion of the center thermistor 52 based on output signals from the center thermistor 52 and the side thermistor 53.

The heater control unit 58 controls the heater power supply circuit 55 based on a condition of the contact portion of the center thermistor 52 and an output signal from the center thermistor 52, to control electric power supplied to the heater 13 from the heater power supply circuit 55. In detail, the heater control unit 58 sets (corrects) a target temperature for a surface temperature of the heating roller 11 based on a condition of the contact portion of the center thermistor 52, and performs feedback control for the heater power supply circuit 55 so as to make a temperature detected by the center thermistor 52 conform to the target temperature.

Note that, in order to prevent anomalous heating of the heating roller 11 due to a failure in the center thermistor 52 or the like, a bimetal switch 60 is provided on the power supply path from the heater power supply circuit 55 to the heater 13. The bimetal switch 60 shuts off a power supply when a surface temperature of the heating roller 11 exceeds a given temperature.

6. Second Condition Determining Processing

Figure 6:
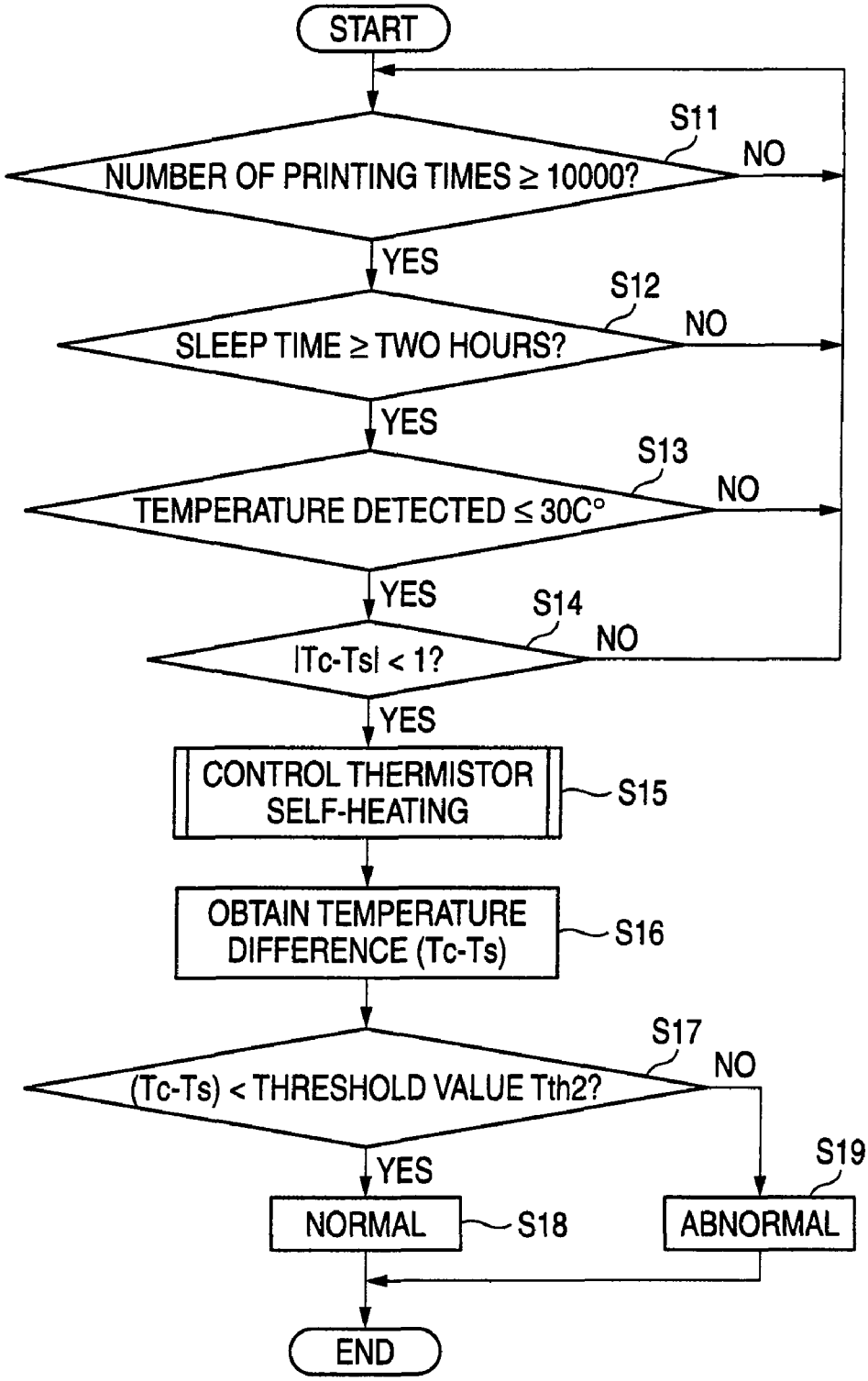
FIG. 6 is a flowchart of second condition determining processing.

FIG. 6 is a flowchart of the second condition determining processing.

The second condition determining processing is executed during a period when an image forming operation is not carried out. In the condition determining processing, first, it is determined whether a number of printing times (a number of times of image forming operations) reaches 10000 or more without new determination after previous determination of a condition of the contact portion of the center thermistor 52 (S11). If the number of printing times is less than 10000 (S11: NO), the processing returns to S11.

If the number of printing times is 10000 or more (S11: YES), it is determined whether a sleep time which is a duration time in a sleep mode reaches two hours or more at that time point (S12). If the sleep time is shorter than two hours (S12: NO), the process returns to S11.

If the sleep time is two hours or more (S12: YES), it is determined whether a temperature detected by the center thermistor 52 is 30° C. or less (S13). If the temperature detected by the center thermistor 52 is higher than 30° C. (S13: NO), the processing returns to S11.

If the temperature detected by the center thermistor 52 is 30° C. or less, it is determined whether a deviation |Tc−Ts| between a temperature Tc detected by the center thermistor 52 and a temperature Ts detected by the side thermistor 53 is less than 1° C. (S14).

If the deviation |Tc−Ts| is 1° C. or more (S14: NO), the processing returns to S11. If the deviation |Tc−Ts| is less that 1° C. (S14: YES), thermistor self-heating control is executed (S15). In this thermistor self-heating control, a voltage applied to the center thermistor 52 and the side thermistor 53 is switched from the first voltage to the second voltage. Thereby, the center thermistor 52 (the resistive element 52*a*) and the side thermistor 53 (the resistive element 53*a*) have self-heating, which rapidly raise the temperatures of the center thermistor 52 and the side thermistor 53. When a heating time period set in advance (the period t1-t2 shown in FIG. 4) elapses after the voltage applied to the center thermistor 52 and the side thermistor 53 is switched from the first voltage to the second voltage, the voltage applied to the center thermistor 52 and the side thermistor 53 is returned from the second voltage to the first voltage. Thereby, the center thermistor 52 and the side thermistor 53 do not actively have self-heating. Therefore, thereafter, the temperatures of (temperatures detected by) the center thermistor 52 and the side thermistor 53 decrease due to a heat radiation from the center thermistor 52.

Because the center thermistor 52 contacts the contact area A of the heating roller 11, extraneous matter is easily transferred from the heating roller 11 to the center thermistor 52. In contrast thereto, because the side thermistor 53 does not contact the contact area A, extraneous matter is hardly transferred from the heating roller 11 to the side thermistor 53. Therefore, when a large amount of extraneous matter is adhered to the contact portion of the center thermistor 52, the decrease of temperature of the center thermistor 52 is delayed as compared with the decrease of temperature of the side thermistor 53.

Therefore, at a time point when a heat-radiating time period set in advance (the time t2-t3 shown in FIG. 4) elapses after the voltage applied to the center thermistor 52 and the side thermistor 53 is returned from the second voltage to the first voltage, a temperature difference (Tc−Ts) between the temperature Tc detected by the center thermistor 52 and the temperature Ts detected by the side thermistor 53 is obtained (S16).

Then, it is determined whether a condition of the contact portion of the center thermistor 52 is normal or abnormal depending on whether the temperature difference (Tc−Ts) is less than a threshold value Tth2 (for example, Tth2=10° C.) as an example of a comparative value. The threshold value Tth2 may be experimentally set in advance and stored in the ROM of the control unit 21.

If the temperature difference (Tc−Ts) is less than the threshold value Tth2 (S17: YES), it is determined that a condition of the contact portion of the center thermistor 52 is normal (S18), and then the condition determining processing ends. On the other hand, if the temperature difference (Tc−Ts) is the threshold value Tth2 or more (S17: NO), it is determined as a condition in which a large amount of extraneous matter (for example, such an amount of destroying the sufficient sensitivity of the center thermistor 22) is adhered to the contact portion of the center thermistor 52 (the condition is abnormal) (S19), and then the condition determining processing ends.

7. Advantages

The center thermistor 52 is provided so as to contact the contact area A contacting the sheet of paper P on the surface of the heating roller 11. The side thermistor 53 is provided so as to contact an area other than the contact area A on the surface of the heating roller 11. A condition of the contact portion of the center thermistor 52 is determined based on a result of comparison between a temperature detected by the center thermistor 52 at a timing when a given time (which may be predetermined) elapses after starting the self-heating of the center thermistor 52 and the side thermistor 53, and a temperature detected by the side thermistor 53 at the same timing.

In detail, a temperature detected by the center thermistor 52 at a time point when a heat-radiating time period (which may be set in advance) elapses after completion of the self-heating of the center thermistor 52 and the side thermistor 53, and a temperature detected by the side thermistor 53 at that time point are compared. Then, a condition of the contact portion with the heating roller 11 on the center thermistor 52 is determined based on a result of the comparison. In more detail, if the temperature difference (Tc−Ts) between the temperature Tc detected by the center thermistor 52 and the temperature Ts detected by the side thermistor 53 is the threshold value Tth2 (which may be set in advance) or more at the time point when the heat-radiating time period elapses, it is possible to determine that a certain amount of extraneous matter is adhered to the center thermistor 52.

Further, a series of processing steps (the steps on and after S15 shown in FIG. 6) for determining a condition of the contact portion of the center thermistor 52 is executed under the condition that a deviation between the temperature Tc detected by the center thermistor 52 and the temperature Ts detected by the side thermistor 53 is 1° C. or less. If the temperature Tc detected by the center thermistor 52 and the temperature Ts detected by the side thermistor 53 are greatly different from each other at a time point when the thermistor self-heating control is started, a temperature difference therebetween causes a difference between temperatures of the center thermistor 52 and the side thermistor 53 after starting the self-heating thereof. In this case, even if a difference is caused between the temperature Tc detected by the center thermistor 52 and the temperature Ts detected by the side thermistor 53 at a timing when the predetermined time elapses after starting the self-heating of the center thermistor 52 and the side thermistor 53, it is unclear whether the difference is caused by a temperature difference before starting the self-heating control of the thermistors or caused by a contacting condition of the contact portion of the center thermistor 52. Therefore, by executing the steps on and after S15 shown in FIG. 6 under the condition that a difference between the temperature Tc detected by the center thermistor 52 and the temperature Ts detected by the side thermistor 53 is 1° C. or less, it is possible to satisfactorily determine a condition of the contact portion of the center thermistor 52. Note that the standard that is 1° C. is just an example, and may appropriately be set.

Further, the thermistors of the same type are adopted as the center thermistor 52 and the side thermistor 53. That is, the center thermistor 52 and the side thermistor 53 have the same characteristic. Therefore, it is possible to satisfactorily determine a condition of the contact portion of the center thermistor 52 based on a result of comparison between the temperature Tc detected by the center thermistor 52 and the temperature Ts detected by the side thermistor 53.

8. Modifications

The black-and-white laser printer is described as an example as the printer 1. However, the present invention can be applied to various types of printers such as a black-and-white LED printer, a color laser printer, and a color LED printer. Further, the present invention can be applied to, not only printers, but also copiers and facsimile machines.

The heating roller 11 is described as an example of a fixing member to heat a toner image on the sheet of paper P. However, the present invention can be applied to image forming apparatuses having various types of fixing members such as a film-type fixing member used for a film-fixing method.

The pressure roller 12 is described as an example of a pressure member made to contact the heating roller 11 with pressure. However, the present invention can be applied to image forming apparatuses having various types of pressure members such as a belt-type pressure member.

The temperatures in units of [° C.] are described as examples of "temperatures." However, in the present invention, values such as a resistance value and a voltage value of the resistive element for temperature detection in the center thermistor 22 can be adopted. Further, data in which temperatures in units of [° C.] are appropriately processed can be adopted as "temperatures."

Figure 7:
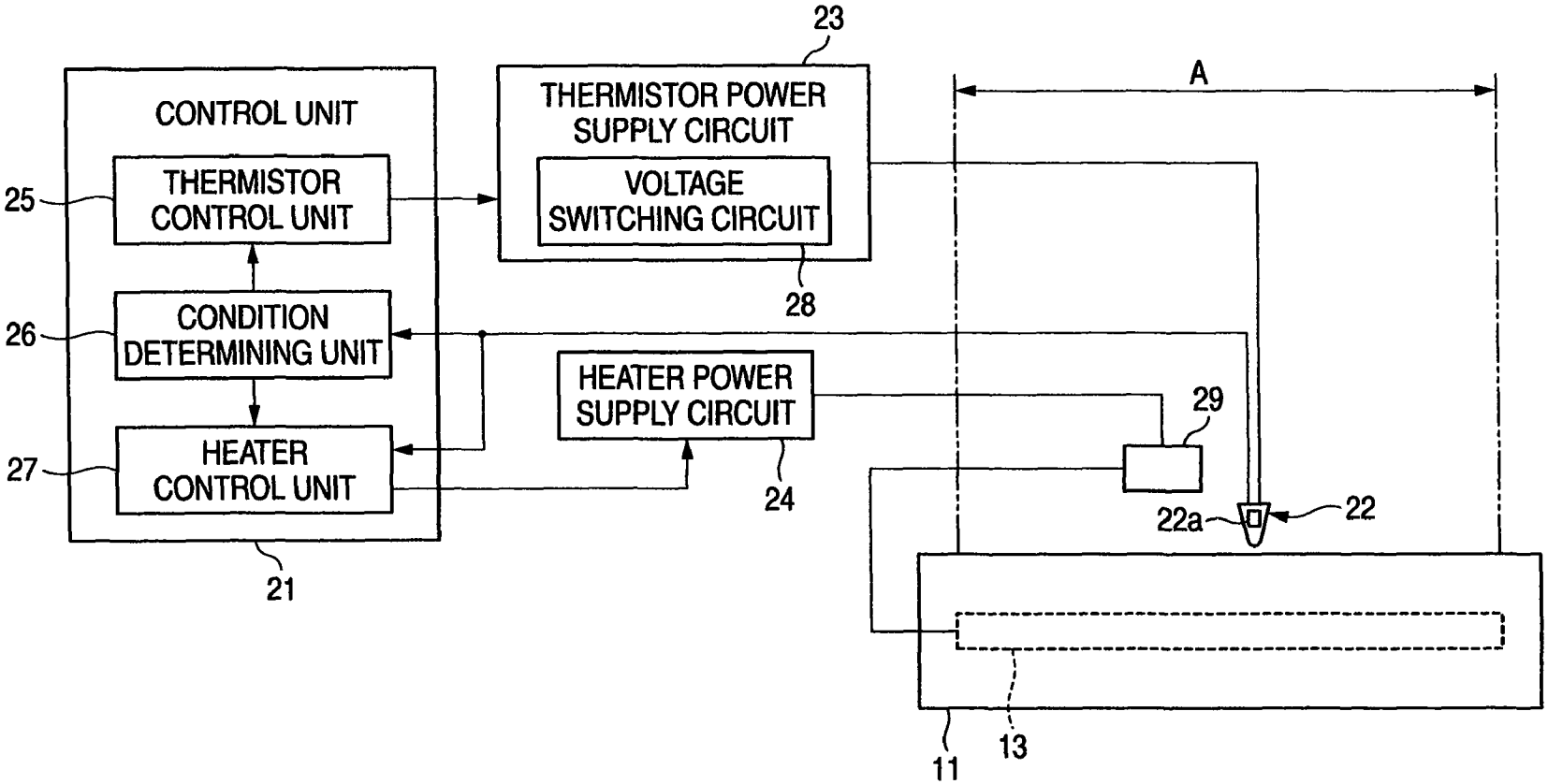
FIG. 7 is a block diagram showing yet another configuration of a control system of the printer.

In the above-described exemplary embodiments, as shown in FIG. 2, the center thermistor 22 is disposed so as to contact the contact area A of the surface of the heating roller 11 to be contacted with the sheet of paper P, and the condition of the contact portion of the center thermistor is determined. However, as shown in FIG. 7, the center thermistor 22 may be spaced from the heating roller 11 so as to face the contact area A. In other words, the center thermistor 22 may include a facing portion that faces the contact area A of the heating roller 11. In this case, by executing the condition determining processing shown in FIG. 3, it is possible to determine a condition of the facing portion of the center thermistor 22. Similarly, at least one of the center thermistor 52 and the side thermistor 53 shown in FIG. 5 may be spaced from the heating roller 11 so as to face the contact area A and an area other than the contact area A, respectively.

9. Illustrative Aspects of Exemplary Embodiments

An image forming apparatus according to a first aspect of the invention includes a detected member, a temperature sensor which is provided so as to contact (or face) the member, and is used for detecting a temperature of the member, and a condition determining unit that controls electric power supplied to the temperature sensor, to cause the temperature sensor to have self-heating during a heating time period set in advance, and determines a condition of a contact portion (or a facing portion) with the member on the temperature sensor based on a temperature detected by the temperature sensor after starting the self-heating.

In accordance with a second aspect of the invention, in the image forming apparatus according to the first aspect, the member is to contact a recording sheet on which an image is recorded.

In accordance with a third aspect of the invention, in the image forming apparatus according to the second aspect, the condition determining unit determines an adhesion condition of foreign matter onto the contact portion (or the facing portion).

In accordance with a fourth aspect of the invention, in the image forming apparatus according to the second aspect or the third aspect, the condition determining unit determines a condition in which the contact portion contacts the member and a condition in which the contact portion is spaced from the member.

In accordance with a fifth aspect of the invention, in the image forming apparatus according to any one of the second to fourth aspects, the condition determining unit stores a comparative value set in advance, and determines a condition of the contact portion (or the facing portion) based on a result of comparison between the comparative value and the temperature detected by the temperature sensor.

In accordance with a sixth aspect of the invention, in the image forming apparatus according to any one of the second to fifth aspects, the condition determining unit determines a condition of the contact portion (or the facing portion) based on an amount of reduction in the temperature detected by the temperature sensor during a heat-radiating time period set in advance after completion of the heating time period.

In accordance with a seventh aspect of the invention, in the image forming apparatus according to any one of the second to fourth aspects, the temperature sensor includes a first temperature sensor which is provided so as to contact (or face) a contact area contacting the recording sheet on the member, and a second temperature sensor which is provided so as to contact (or face) an area other than the contact area on the member, and the condition determining unit determines a condition of the contact portion (or the facing portion) with the member on the first temperature sensor based on a result of comparison between a temperature detected by the first temperature sensor at a timing when a predetermined time elapses after starting the self-heating and a temperature detected by the second temperature sensor at the timing.

In accordance with an eighth aspect of the invention, in the image forming apparatus according to the seventh aspect, the condition determining unit executes a series of processing steps for determining a condition of the contact portion (or the facing portion) under the condition that a difference between the temperature detected by the first temperature sensor and the temperature detected by the second temperature sensor is less than or equal to a threshold value set in advance.

In accordance with a ninth aspect of the invention, in the image forming apparatus according to the seventh aspect or the eighth aspect, the first temperature sensor and the second temperature sensor are of the same type.

In accordance with a tenth aspect of the invention, in the image forming apparatus according to any one of the seventh to ninth aspects, the timing is a time point when the heat-radiating time period set in advance elapses after the completion of the heating time period.

In accordance with an eleventh aspect of the invention, in the image forming apparatus according to any one of the second to tenth aspects, the condition determining unit executes the series of processing steps for determining a condition of the contact portion (or the facing portion) under the condition that an operation for forming an image on the recording sheet is carried out a number of times set in advance or more without determining a condition of the contact portion (or the facing portion).

In accordance with a twelfth aspect of the invention, in the image forming apparatus according to any one of the first to eleventh aspects, the condition determining unit executes the series of processing steps processings for determining a condition of the contact portion (or the facing portion) under the condition that the temperature detected by the temperature sensor is less than or equal to a temperature set in advance.

In accordance with a thirteenth aspect of the invention, in the image forming apparatus according to any one of the first to twelfth aspects, a heating member that heats the member is further provided, and the condition determining unit executes the series of processing steps for determining a condition of the contact portion (or the facing portion) under the condition that a non-heating condition of the member by the heating member continues for a time set in advance or more.

10. Advantages of Illustrative Aspects of Exemplary Embodiments

In accordance with the first aspect of the invention, the temperature sensor for detecting a temperature of the member to be detected is provided so as to contact (or face) the member. In order to determine a condition of the contact portion (or the facing portion) with the member on the temperature sensor, electric power supplied to the temperature sensor is controlled so as to cause the temperature sensor to have self-heating. Then, a condition of the contact portion (or the facing portion) of the temperature sensor is determined based on a temperature detected by the temperature sensor after starting the self-heating.

Because the temperature sensor is configured to have self-heating, a substantially constant heating value is supplied to the temperature sensor independently of the type of the member. Accordingly, it is possible to determine a condition of the contact portion (or the facing portion) of the temperature sensor without depending very much on the type of the member. Therefore, a correction level corresponding to a condition of the contact portion (or the facing portion) of the temperature sensor without depending very much on the type of the member, and it is possible to precisely correct a temperature detected by the temperature sensor based on the correction level.

In accordance with the second aspect of the invention, the member contacts the recording sheet on which an image is recorded. Therefore, extraneous matter (foreign matter) adhered to the recording sheet is transferred to the member. The extraneous matter transferred to the member is further transferred from the member to the temperature sensor. If the extraneous matter is adhered to the temperature sensor, the sensitivity of the temperature sensor is deadened. Therefore, it is possible to precisely detect a temperature of the member by determining an adhesion condition (for example, whether a certain amount of extraneous matter to such an extent that the sensitivity of the temperature sensor is deadened, is adhered), and correcting a temperature detected by the temperature sensor based on the adhesion condition.

In accordance with the third aspect of the invention, it is possible to determine an adhesion condition of foreign matter onto the contact portion (or the facing portion) with the member on the temperature sensor.

In accordance with the fourth aspect of the invention, it is possible to determine a condition in which the contact portion with the member on the temperature sensor contacts the member and a condition in which the contact portion is spaced from the member.

In accordance with the fifth aspect of the invention, a condition of the contact portion (or the facing portion) of the temperature sensor is determined based on a result of comparison between the comparative value set in advance and the temperature detected by the temperature sensor.

When a condition of the contact portion (or the facing portion) of the temperature sensor is in a normal condition, for example, at a timing when a predetermined time elapses after starting the self-heating of the temperature sensor, a temperature detected of the temperature sensor comes to a substantially constant temperature. Therefore, by setting a value corresponding to the constant temperature as a comparative value, when a temperature detected by the temperature sensor and the comparative value are greatly different from each other, it is possible to determine that a condition of the contact portion (or the facing portion) of the temperature sensor is not in a normal condition (that is, abnormal).

In accordance with the sixth aspect of the invention, a condition of the contact portion (or the facing portion) of the temperature sensor is determined based on an amount of reduction in the temperature detected by the temperature sensor during a heat-radiating time period set in advance after completion of the self-heating of the temperature sensor.

When a condition of the contact portion (or the facing portion) of the temperature sensor is in a normal condition, a temperature of the temperature sensor is lowered by substantially a given amount, for example, during the heat-radiating time period set in advance after completion of the self-heating of the temperature sensor. Therefore, when an amount of reduction in the temperature detected by the temperature sensor during the heat-radiating time period is greatly different from the given amount, it is possible to determine that a condition of the contact portion (or the facing portion) of the temperature sensor is not in a normal condition (that is, abnormal).

In accordance with the seventh aspect of the invention, the temperature sensor includes the first temperature sensor and the second temperature sensor. The first temperature sensor is provided so as to contact (or face) the contact area contacting the recording sheet on the member. On the other hand, the second temperature sensor is provided so as to contact (or face) the area other than the contact area on the member. Then, a condition of the contact portion (or the facing portion) with the member on the first temperature sensor is determined based on a result of comparison between a temperature detected by the first temperature sensor at a timing when a predetermined time elapses after starting the self-heating of the first and second temperature sensors and a temperature detected by the second temperature sensor at the same timing.

Because the first temperature sensor contacts (or faces) the contact area, extraneous matter is easily transferred from the member to the first temperature sensor. In contrast thereto, because the second temperature sensor does not contact the contact area, extraneous matter is hardly transferred from the member to the second temperature sensor. Therefore, in a case in which a temperature detected by the first temperature sensor and a temperature detected by the second temperature sensor are greatly different from each other at a timing when a predetermined time elapses after starting the self-heating, for example, it is possible to determine that a certain amount of extraneous matter is adhered to the first temperature sensor.

In accordance with the eighth aspect of the invention, the series of processing steps for determining a condition of the contact portion (or the facing portion) of the first temperature sensor is executed under the condition that a difference between the temperature detected by the first temperature sensor and the temperature detected by the second temperature sensor is less than or equal to the threshold value set in advance.

In a case in which the temperature detected by the first temperature sensor and the temperature detected by the second temperature sensor are greatly different from each other before starting the series of processing steps, a temperature difference therebetween causes a difference between temperatures of the first and second temperature sensors after starting the self-heating thereof. In this case, even if a difference is caused between the temperature detected by the first temperature sensor and the temperature detected by the second temperature sensor at a timing when the predetermined time elapses after starting the self-heating of the first and second temperature sensors, it is unclear whether the difference is caused by a temperature difference before starting the series of processing steps, or caused by a contacting condition (facing condition) of the contact portion (or the facing portion) of the first temperature sensor. Therefore, it is possible to satisfactorily determine a condition of the contact portion (or the facing portion) of the first temperature sensor by executing the series of processing steps under the condition that a difference between the temperature detected by the first temperature sensor and the temperature detected by the second temperature sensor is less than or equal to the threshold value set in advance.

In accordance with the ninth aspect of the invention, sensors of the same type are adopted as the first and second temperature sensors. Thereby, the first and second temperature sensors have the same characteristic. Therefore, it is possible to satisfactorily determine a condition of the contact portion (or the facing portion) of the first temperature sensor based on a result of comparison between the temperature detected by the first temperature sensor and the temperature detected by the second temperature sensor.

In accordance with the tenth aspect of the invention, the temperature detected by the first temperature sensor at a time point when the heat-radiating time period set in advance elapses after completion of the self-heating of the first and second temperature sensors and the temperature detected by the second temperature sensor at that time point are compared. Then, a condition of the contact portion (or the facing portion) with the member on the first temperature sensor is determined based on a result of the comparison.

In a condition in which a certain amount of extraneous matter to such an extent that the sensitivity of the first temperature sensor is deadened, is not adhered to the first temperature sensor, the temperatures of the first and second temperature sensors are lowered in substantially the same way during the heat-radiating time period set in advance after completion of the self-heating of the first and second temperature sensors. Therefore, if there is a great difference between the temperature detected by the first temperature sensor and the temperature detected by the second temperature sensor at the time point when the heat-radiating time period elapses, for example, it is possible to determine that a certain amount of extraneous matter is adhered to the first temperature sensor.

In accordance with the eleventh aspect of the invention, the series of processing steps for determining a condition of the contact portion (or the facing portion) of the temperature sensor is executed under the condition that an operation for forming an image is carried out the number of times set in advance or more without determining a condition of the contact portion (or the facing portion). Thereby, it is possible to avoid frequently executing the series of processing steps for determining a condition of the contact portion (or the facing portion) of the temperature sensor.

In accordance with the twelfth aspect of the invention, the series of processing steps for determining a condition of the contact portion (or the facing portion) of the temperature sensor is executed under the condition that the temperature detected by the temperature sensor is less than or equal to the temperature set in advance.

If the temperature detected by the temperature sensor is higher than the temperature set in advance before starting the series of processing steps, the temperature at that time has an effect on temperature changes after starting the self-heating of the temperature sensor, which may make it impossible to accurately determine a condition of the contact portion (or the facing portion) of the temperature sensor. Therefore, it is possible to satisfactorily determine a condition of the contact portion (or the facing portion) of the temperature sensor by executing the series of processing steps under the condition that the temperature detected by the temperature sensor is less than or equal to the temperature set in advance.

In accordance with the thirteenth aspect of the invention, the heating member that heats the member is provided in the image forming apparatus. Then, the series of processing steps for determining a condition of the contact portion (or the facing portion) is executed under the condition that a non-heating condition of the member by the heating member continues for the time set in advance or more.

If heating of the member by the heating member is carried out immediately before the series of processing steps, the heating has an effect on temperature changes after starting the self-heating of the temperature sensor, which may make it impossible to accurately determine a condition of the contact portion (or the facing portion) of the temperature sensor. Therefore, it is possible to satisfactorily determine a condition of the contact portion (or the facing portion) of the temperature sensor by executing the series of processing steps under the condition that a non-heating condition of the member by the heating member continues for the time set in advance or more.

11. Variations and Modifications of Exemplary Embodiments

Although the invention has been described above in relation to exemplary embodiments thereof, it will be understood by those skilled in the art that variations and modifications can be effected in these exemplary embodiments without departing from the scope and spirit of the invention.

What is claimed is:

1. An image forming apparatus comprising:

a detected member;

a temperature sensor comprising a contact portion provided to contact the detected member, the temperature sensor being configured to detect the temperature of the detected member;

a processor; and memory having machine readable instructions stored thereon that, when executed by the processor, cause the image forming apparatus to provide a condition determining unit configured to control electric power supplied to the temperature sensor such that the temperature sensor self-heats during a heating time period, and determine a condition of the contact portion based on the temperature detected by the temperature sensor after the temperature sensor starts self-heating.

2. The image forming apparatus according to claim 1, wherein the detected member is configured to contact a recording sheet on which an image is recorded.

3. The image forming apparatus according to claim 2, wherein the condition determining unit determines an adhesion condition of foreign matter adhered to the contact portion.

4. The image forming apparatus according to claim 2, wherein the condition determining unit determines whether the contact portion contacts the detected member.

5. The image forming apparatus according to claim 2, wherein the condition determining unit stores a comparative value, and determines the condition of the contact portion based on a result of comparison between the comparative value and the temperature detected by the temperature sensor.

6. The image forming apparatus according to claim 2, wherein the condition determining unit determines the condition of the contact portion based on an amount of reduction in the temperature detected by the temperature sensor during a heat-radiating time period that is set after completion of the heating time period.

7. The image forming apparatus according to claim 2, wherein the detected member comprises:

a first area to contact the recording sheet; and a second area not to contact the recording sheet, wherein the temperature sensor comprises:

a first temperature sensor comprising a first contact portion contacting the first area of the detected member; and a second temperature sensor comprising a second contact portion contacting the second area of the detected member, and wherein the condition determining unit determines the condition of the first contact portion based on a result of comparison between temperatures detected by the first temperature sensor and the second temperature sensor at a timing when a predetermined time elapses after starting self-heating.

8. The image forming apparatus according to claim 7, wherein the condition determining unit executes a series of processing steps for determining the condition of the first contact portion under a condition that a difference between the temperature detected by the first temperature sensor and the temperature detected by the second temperature sensor is a threshold value or less.

9. The image forming apparatus according to claim 7, wherein the first temperature sensor and the second temperature sensor are of a same type.

10. The image forming apparatus according to claim 7, wherein the timing is a time point that a heat-radiating time period elapses after the completion of the heating time period.

11. The image forming apparatus according to claim 2, wherein the condition determining unit executes a series of processing steps for determining the condition of the contact portion under a condition that a number of an operation for forming an image on the recording sheet is a threshold number or more without determining the condition of the contact portion.

12. The image forming apparatus according to claim 1, wherein the condition determining unit executes a series of processing steps for determining the condition of the contact portion under a condition that the temperature detected by the temperature sensor is a threshold temperature or less.

13. The image forming apparatus according to claim 1, further comprising a heating member configured to heat the detected member, wherein the condition determining unit executes a series of processings processing step for determining the condition of the contact portion under a condition that the heating member does not heat the detected member for a threshold time period or more.

14. A non-transitory computer readable medium having a computer program stored thereon and readable by a computer, said computer program, when executed by the computer, causes the computer to perform operations for an image forming apparatus that comprises a detected member; and a temperature sensor comprising a contact portion provided to contact the detected member, the temperature sensor being configured to detect the temperature of the detected member, said operations comprising:

controlling electric power supplied to the temperature sensor such that the temperature sensor self-heats during a heating time period; and determining a condition of the contact portion based on the temperature detected by the temperature sensor after the temperature sensor starts self-heating.

15. An image forming apparatus comprising:

a detected member;

a temperature sensor comprising a facing portion provided to face the detected member, the temperature sensor being configured to detect the temperature of the detected member;

a processor;

memory having machine readable instructions stored thereon that, when executed by the processor, cause the image forming apparatus to provide a condition determining unit configured to control electric power supplied to the temperature sensor such that the temperature sensor self-heats during a heating time period, and determine a condition of the facing portion based on the temperature detected by the temperature sensor after the temperature sensor starts self-heating.

16. The image forming apparatus according to claim 15, wherein the condition determining unit determines an adhesion condition of foreign matter adhered to the facing portion.

17. The image forming apparatus according to claim 15, wherein the condition determining unit stores a comparative value, and determines the condition of the facing portion based on a result of comparison between the comparative value and the temperature detected by the temperature sensor.

18. The image forming apparatus according to claim 15, wherein the condition determining unit determines the condition of the facing portion based on an amount of reduction in the temperature detected by the temperature sensor during a heat-radiating time period that is set after completion of the heating time period.

19. The image forming apparatus according to claim 15, wherein the condition determining unit executes a series of processing steps for determining the condition of the facing portion under a condition that a number of an operation for forming an image on a recording sheet is a threshold number or more without determining the condition of the facing portion.

20. The image forming apparatus according to claim 15, wherein the condition determining unit executes a series of processing steps for determining the condition of the facing portion under a condition that the temperature detected by the temperature sensor is a threshold temperature or less.

* * * * *

UNITED STATES PATENT AND TRADEMARK OFFICE

CERTIFICATE OF CORRECTION

PATENT NO. : 8,175,472 B2
APPLICATION NO. : 12/411795
DATED : May 8, 2012
INVENTOR(S) : Noboru Suzuki It is certified that error appears in the above-identified patent and that said Letters Patent is hereby corrected as shown below:

Column 18, Claim 13, Line 51-52:
Please delete "of processings processing step" and insert --of processing steps--

Signed and Sealed this
Eleventh Day of December, 2012

David J. Kappos

David J. Kappos
*Director of the United States Patent and Trademark Office*